US005939986A

United States Patent [19]

Schiffbauer et al.

[11] Patent Number: 5,939,986

[45] Date of Patent: Aug. 17, 1999

[54] MOBILE MACHINE HAZARDOUS WORKING ZONE WARNING SYSTEM

[75] Inventors: William H. Schiffbauer, Connellsville; Carl W. Ganoe, Pittsburgh, both of Pa.

[73] Assignee: The United States of America as represented by the United States Department of Energy, Washington, D.C.

[21] Appl. No.: 08/733,846

[22] Filed: Oct. 18, 1996

[51] Int. Cl.[6] ..... G08B 23/00

[52] U.S. Cl. ..... 340/573.1; 340/539; 340/541; 455/41

[58] Field of Search ..... 340/539–541, 340/571, 573.1, 551–554, 679, 680, 944; 455/41, 517

[56] References Cited

U.S. PATENT DOCUMENTS

| | | | |
|---|---|---|---|
| 4,100,529 | 7/1978 | Evans | 340/901 |
| 5,047,752 | 9/1991 | Schorn | 340/552 |
| 5,086,290 | 2/1992 | Murray et al. | 340/573 |
| 5,198,800 | 3/1993 | Tozawa et al. | 340/573 |
| 5,477,210 | 12/1995 | Belchre | 340/573 |
| 5,575,242 | 11/1996 | Davis et al. | 340/573 |

*Primary Examiner*—Daniel J. Wu
*Attorney, Agent, or Firm*—Mark F. LaMarre; Mark P. Dvorscak; William R. Moser

[57] ABSTRACT

A warning system is provided for a mobile working machine to alert an individual of a potentially dangerous condition in the event the individual strays into a hazardous working zone of the machine. The warning system includes a transmitter mounted on the machine and operable to generate a uniform magnetic field projecting beyond an outer periphery of the machine in defining a hazardous working zone around the machine during operation thereof. A receiver, carried by the individual and activated by the magnetic field, provides an alarm signal to alert the individual when he enters the hazardous working zone of the machine.

14 Claims, 1 Drawing Sheet

MOBILE MACHINE HAZARDOUS WORKING ZONE WARNING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates generally to a system for providing individuals engaged in activity around a mobile working machine with an indication of the machine's location and, more particularly, to a warning system for alerting an individual who strays into a hazardous working zone of the machine during operation thereof.

2. Description of the Prior Art

Mobile working machines are used in many industrial and commercial applications to facilitate the performance of work-related tasks. Machines such as forklifts, front-end loaders, cranes, mining equipment and locomotives of all types have been used for many years to allow workers to perform tasks that otherwise would not be capable of being done. As these various types of working machines have evolved over time, it has been seen as an advantage in some instances to equip working machines with a remote control feature which removes the operator from the machine itself and thus allows the operator to not only control the machine but also perform other tasks when the services of the machine are not required. Equipping working machines with a remote control feature which allows the machine operator to also perform other tasks optimizes manpower and results in a cost saving for companies which employ this type of equipment. Remote control machines provide an added benefit in that they may be designed without considering the requirements necessary to protect an on-board operator and allow the operator to interface with the machine.

Although much effort has been spent in recent years attempting to provide remote controlled working machines of both the radio and hard-wired variety that may be operated safely at all times and in all working environments, it is well recognized that the use of these types of machines has led to the injury and, in some instances, death of mobile working machine operators and others working in close proximity to the machines. In recognition of the safety hazards these types of machines present, attempts have been made to design safety alarm systems capable of providing some form of audible or visual warning signal to machine operators and other personnel working around these machines that would indicate when a potentially dangerous working condition exists. However, the warning systems that have been proposed to date have not been sufficient.

For example, a doppler radar system has been investigated that is capable of providing an indicator to a mobile working machine operator that an obstacle is in the path of the machine. This radar system is intended to warn the machine operator that some object was in his path, but it has not been accepted from a safety standpoint since it only works with working machines that utilize an "on-board" operator and not with mobile machines that are remote controlled. In addition, the doppler radar system is incapable of distinguishing between an individual who had strayed too close to the machine and an inanimate object.

An ultrasonic sensing system has also been investigated as a mobile working machine alarm system. However, this system operates in a manner very similar to the doppler radar system in that it also cannot distinguish between an individual and an inanimate object. Infrared systems have been found unacceptable because they too cannot discriminate between individuals and objects and further they are subject to false alarms due to bright lights and reflections.

As seen from the foregoing, although various types of warning systems have been suggested for use with mobile working machines that are capable of providing a safety proximity alarm, all have shortcomings which preclude their use. Consequently, there is a need for an improved warning system operable to warn an individual of a potentially dangerous condition if he strays into the hazardous working zone of the machine.

SUMMARY OF THE INVENTION

The present invention relates to a warning system for a mobile working machine designed to satisfy the aforementioned needs. The warning system of the present invention is operable to warn an individual should he stray into a potentially dangerous area defined as the hazardous working zone of the machine. The warning system utilizes a transmitter with directional antenna loops strung along potentially dangerous areas of the machine so as to create a uniform and totally predictable magnetic field about the machine which effectively marks or identifies a hazardous working zone around the machine. The warning system further includes a receiver carried by the individual and activated by the magnetic field to warn the individual both audibly and visually should he stray into the hazardous working zone of the machine.

Accordingly, the present invention is directed to a warning system for a mobile working machine to alert an individual who strays into a hazardous working zone of the machine. The warning system comprises: (a) transmitter means mounted on the machine and operable to generate a magnetic field projecting beyond an outer periphery of the machine in defining a hazardous working zone enveloping the machine upon operation thereof; and (b) receiver means carried by an individual and operably associated with the transmitter means to provide an alarm signal to alert the individual upon entering the hazardous working zone of the machine.

The transmitter means includes a transmitter tuneable to a selected frequency and operable to generate a current signal and a transmitter antenna connected to the transmitter and operable upon receipt of the current signal to generate the magnetic field. The transmitter includes a tuneable oscillator for generating an output signal of selected frequency, loop driver means for amplifying the output signal generated by the oscillator to form the current signal provided to the transmitter antenna, and a buffer amplifier electrically disposed between the oscillator and the loop driver means for providing isolation between the oscillator and the loop driver means. The oscillator operates at a selected frequency adjustable between 500 Hz and 100 KHz. Preferably, the transmitter antenna includes a plurality of wire loops with each wire loop being connected to the transmitter and positioned at a selected location on the machine identified as a potentially dangerous area, the plurality of wire loops providing a uniform magnetic field upon operation of the transmitter in defining the hazardous working zone having an outer shape that envelopes the machine.

The receiver means of the warning system includes a receiver antenna in the form of a ferrite loop operable to detect the magnetic field generated by the transmitter means and to generate a receiver signal in response thereto; a bandpass filter connected to the ferrite loop antenna for receiving the receiver signal and tuned to the selected frequency of the transmitter means so that all frequencies of the receiver signal other than the frequency corresponding to the selected frequency are stripped from the receiver signal in thereby leaving only the alarm signal; an amplifier connected to the bandpass filter for receiving the alarm signal and increasing the amplitude thereof to a usable amplitude; and a signal detector for receiving the alarm signal from the amplifier and converting it to a DC voltage proportional in magnitude to the strength of the alarm signal. The DC voltage, depending on its magnitude, drives either a first emitting diode device to visually caution the individual of his position relative to the hazardous working zone of the machine or a second light emitting diode device and an alarm driver which excites a peizo alarm to visually and audibly warn the individual of his position relative to the hazardous working zone of the machine. The alarm driver is also capable of shutting down the machine.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

As will be described herein, the hazardous warning system of the present invention is operable to provide protection for individuals working around remote-controlled mobile machines of all types, including but not limited to, radio controlled and hard-wired machines. If either the operator or his helper or another individual strays into what is considered a potentially dangerous area around the mobile working machine, an alarm is triggered to alert the individual that he has entered a hazardous working zone of the machine, and thus, the individual should be extremely cautious and/or move to a position of safety. In addition, the hazardous warning system of the present invention is capable of shutting down the machine upon detection of an impending disaster such as when an individual is in imminent danger of being struck by the machine.

Figure 1:
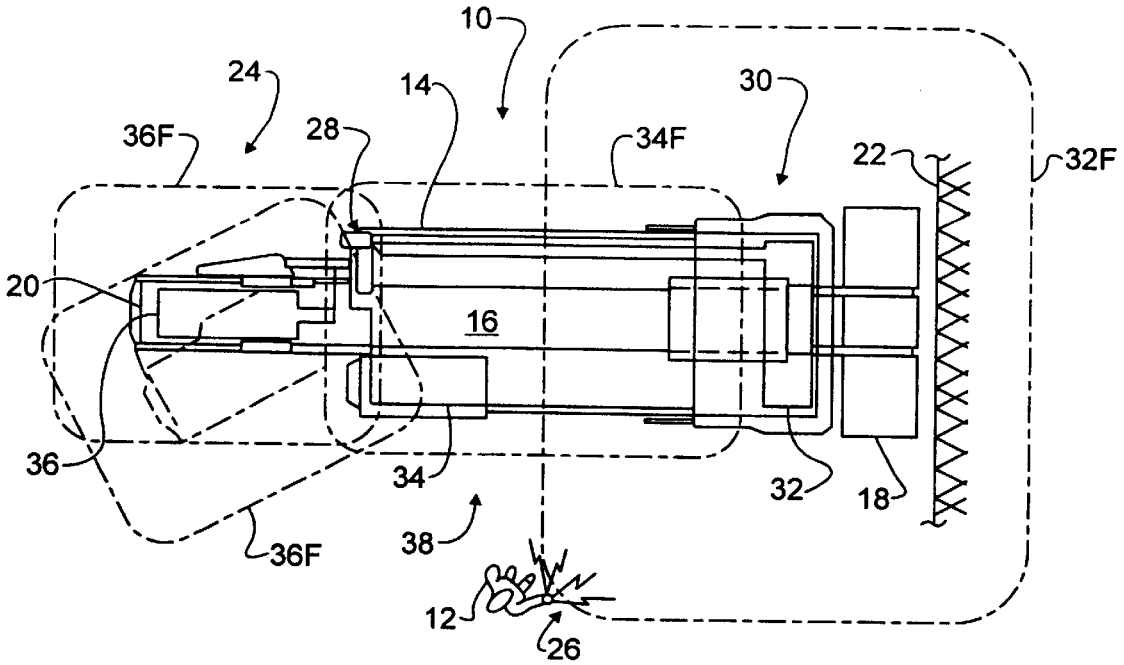
FIG. 1 is a top plan schematic view of a mobile working machine and an operator standing adjacent the machine which illustrates the warning system of the present invention that operates to define and detect a hazardous working zone adjacent the machine.

Now referring to the drawings, and particularly to FIG. 1, there is shown a mobile working machine, generally designated by the numeral 10, operable to perform useful work. Although the machine illustrated and depicted in the drawing is an underground mining machine, it is to be understood that the warning system of the present invention may be employed with any type of mobile working machine. The mining machine 10 is a radio controlled machine being operated remotely by operator 12 standing adjacent the machine and since this machine is well known in the art, only a brief discussion of its components and operation will follow. Basically, the mining machine 10 includes a main body 14 supported on a track drive (not shown), a longitudinally extending conveyor belt 16 supported on the upper portion of the main body, a front cutting head 18 mounted on the forward end of the main body, and a rear discharge chute 20 mounted for articulated movement on the rearward end of the main body as shown in solid-line and phantom-line forms. The cutting head 18 operates to remove coal from the face 22 of the mine and transfers the cut coal rearwardly, via conveyor belt 16, to the rear discharge chute 20 for discharging of the cut coal behind the machine 10 or to an alternate transfer system (not shown). As customary, the operator 12 or his helper may be required to approach the mine face 22 in the event the cutting head 18 experiences difficulties or if he needs to closely observe the cutting operation. This positioning obviously places the individual in a potentially dangerous location adjacent the mining machine 10. Additionally, the operator 12 or his helper may also find himself in close proximity to the track drive or the articulating rear discharge chute 20 during the operation of the machine 10 which are also potentially dangerous areas. Consequently, the hazardous warning system of the present invention, as described below, has been designed to help prevent injury to individuals working around the mining machine 10 by providing an alarm to alert the individual who has placed himself in a potentially dangerous condition should he stray into a hazardous zone adjacent the machine during operation thereof.

Basically, the warning system of the present invention comprises transmitter means 24 disposed on the mining machine 10 and receiver means 26 carried by the operator 12. The transmitter means 24 includes a transmitter 28 positioned on the mining machine 10 which generates an electrical current upon operation thereof and a transmitter antenna, generally designated by the numeral 30, electrically connected to the transmitter 28 and operable to generate a magnetic field as current is transmitted therethrough by the transmitter 28. In the preferred embodiment, the transmitter antenna 30 takes the form of a plurality of separate wire loops 32, 34 and 36, with each wire loop being strung out or positioned along the outer periphery of the different parts of the machine 10 identified as potentially dangerous areas, such as, about the front cutting head 18, the main body 14, and the rear discharge chute 20. Preferably, the wire loops 32, 34 and 36 are composed of insulated copper wire and can be made to conform to almost any shape so as to minimize installation problems. As seen in FIG. 1, wire loop 32 is positioned about the periphery of the cutting head 18; wire loop 34 is positioned about the periphery of the main body 14 of machine 10; and wire loop 36 is positioned about the periphery of the rear discharge chute 20. Upon operation of the transmitter 28, current passes through each of the wire loops 32, 34 and 36 causing the formation of corresponding magnetic fields 32F, 34F and 36F about the respective cutting head 18, main body 14 and rear discharge chute 20. Each of the magnetic fields 32F, 34F and 36F extends outwardly in all directions a desired distance beyond the outer periphery of each of the corresponding components of the machine that has been identified as a potentially dangerous area, the desired distance of the field beyond the outer periphery of the machine component being controlled and/or adjusted by the amount of current supplied to each of the wire loops 32, 34 and 36 by the transmitter 28. As can be seen, magnetic fields 32F, 34F and 36F overlap and combine to totally envelope the mining machine 10 and extend outwardly beyond the outer periphery of the mining machine 10 in defining a hazardous working zone, being generally indicated by the numeral 38. Although the transmitter antenna 30 has been illustrated as three separate wire loops 32, 34 and 36 positioned on three corresponding components or potentially dangerous areas of the mining machine 10, it should be understood that the number, geometric shape and position of the wire loop antennas are dependent upon the peripheral shape of the mobile working machine with which they are employed and the desired outer envelope shape of the hazardous working zone. By controlling the level of the current passed through each of the wire loop antennas, the overall shape of the uniform magnetic field and thus the outer envelope shape of the hazardous working zone may be adjusted.

Figure 2:
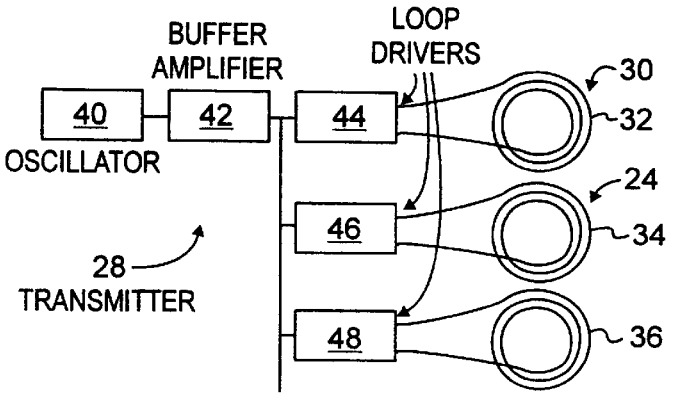
FIG. 2 is a block diagram of the transmitter means of the warning system of the present invention which operates to generate a uniform magnetic field projecting beyond the outer periphery of the machine to define a hazardous working zone enveloping the machine.

As shown in block diagram form in FIG. 2, the transmitter 28 of the transmitter means 24 is formed from readily available components and consists of oscillator 40, a buffer amplifier 42, and three loop drivers 44, 46 and 48 which are all electrically connected and interconnected to a battery power source (not shown). The oscillator 40 is modular in that the frequency of the output signal generated therefrom can be changed or tuned to suit the electrical noise environment of the particular working machine to which the warning system is being applied. The typical range of frequency operation of the oscillator 40 is between 500 Hz and 100 KHz. The output signal generated by the oscillator 40 is provided to the buffer amplifier 42 which is a broad band amplifier operable to isolate the oscillator 40 from the loop drivers 44, 46 and 48. The output signal from the oscillator 40 passes through the buffer amplifier 42 to the three loop drivers 44, 46 and 48. Each of the loop drivers 44, 46 and 48 is a power amplifier and is connected to one of the wire loop antennas 32, 34 and 36. As shown in FIG. 2, the loop driver 44 is connected to the wire loop antenna 32, the loop driver 46 is connected to the wire loop antenna 34, and the loop driver 48 is connected to the wire loop antenna 44. Each of the loop drivers 44, 46 and 48 amplifies the output signal delivered from the oscillator 40 to provide output signals to the wire loop antenna 32, 34 and 36 of sufficient strength to generate the desired magnetic fields 32F, 34F and 36F. As stated earlier, the loop current is varied to adjust the range of the magnetic field and thus the outer envelope shape of the hazardous working zone.

Figure 3:
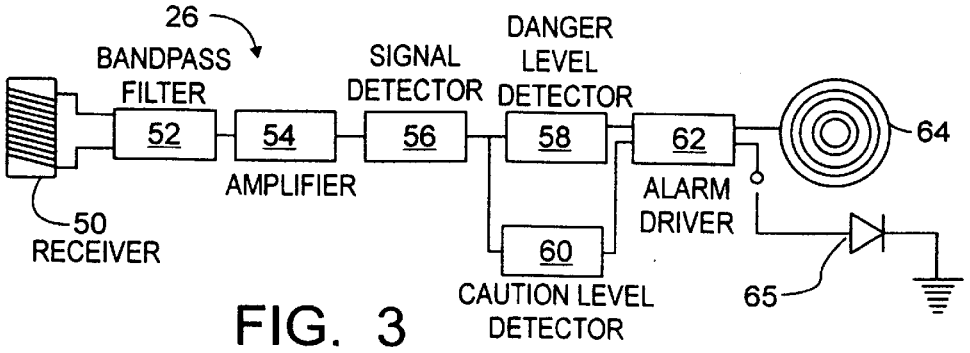
FIG. 3 is a block diagram of the receiver means of the warning system of the present invention carried by the operator which operates to provide an alarm signal to alert the operator that he has strayed into the hazardous working zone of the machine.

FIG. 3 illustrates, in block diagram fashion, the receiver means 26 of the hazardous warning system of the present invention which is carried by the operator 12 and any other person or persons working in the vicinity of the mining machine 10 and is operational to alert this individual if he should stray into the hazardous working zone 38 of machine 10. Basically, the receiver means 26 consists of a ferrite loop antenna 50, a bandpass filter 52, an amplifier 54, a signal detector 56, a danger level detector 58, a caution level detector 60, an alarm driver 62, a yellow light emitting diode, a red light emitting diode 65, and a peizo alarm device 64 which are all conventional off the shelf items that are electrically connected and interconnected to a suitable battery power source (not shown). Should the operator 12, who's carrying the receiver means 26, stray into the hazardous working zone 38 of machine 10, which is defined by the magnetic fields 32F, 34F and 36F, the ferrite loop antenna 50 of the receiver means 26 picks up the signal transmitted by one or the other of these magnetic fields (hereinafter referred to as an alarm signal) and delivers it to the bandpass filter 52. The bandpass filter 52 is tuned to the selected frequency of operation of the oscillator 40 of the transmitter 28 so that all frequencies of the alarm signal, other than the frequency corresponding to the selected frequency of the oscillator 40 are stripped from the alarm signal. The alarm signal is then passed to the amplifier 54 for increasing its amplitude before passing to the signal detector 56 which operates to derive a DC voltage that is proportional to the magnitude of the alarm signal which is likewise proportional to the strengths of the magnetic fields 32F, 34F and 36F forming the hazardous working zone 38. Depending upon the magnitude of the DC voltage, either the caution level detector 60 or the danger level detector 58 are activated. If the magnitude of the DC voltage is below a selected level, the caution level detector 60 is activated wherein a yellow flashing light visually cautions the operator 12 of his position relative to the hazardous working zone 38 of machine 10. If the magnitude of the DC voltage is above a selected level, the danger level detector 58 is activated to emit a red flashing light and the alarm driver 62 excites the peizo alarm device 64 so that an individual, such as operator 12, is warned both visually and audibly of his position relative to the hazardous working zone 38 of the working machine 10. Additionally, the alarm driver 62 can contain circuitry to generate a shutdown signal which operates in conjunction with the ignition system of machine 10 to shut it down.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the form hereinbefore described being merely a preferred or exemplary embodiment thereof.

We claim:

1. A warning system for a mobile working machine to alert an individual who strays into a hazardous working zone of the machine, said warning system comprising:

(a) transmitter means mounted on said machine and operable to generate a magnetic field projecting beyond an outer periphery of said machine in defining a hazardous working zone enveloping said machine upon operation thereof, and (b) receiver means responsive to the magnetic field generated by said transmitter, said receiver means carried by an individual to provide an alarm signal to alert the individual upon entering said hazardous working zone of said machine.

2. The warning system as recited in claim 1, wherein said transmitter means includes:

a transmitter tuneable to a selected frequency and operable to generate a current signal; and a transmitter antenna connected to said transmitter and operable upon receipt of said current signal to generate said magnetic field.

3. The warning system as recited in claim 2, wherein said transmitter antenna includes at least one wire loop positioned adjacent an outer periphery of said machine and operable to generate said magnetic field projecting beyond said outer periphery in defining said hazardous working zone.

4. The warning system as recited in claim 2, wherein said transmitter antenna includes a plurality of wire loops with each wire loop being connected to said transmitter and positioned at a selected location on said machine identified as a potentially dangerous area, said plurality of wire loops providing a uniform magnetic field upon operation of said transmitter in defining said hazardous working zone having an outer shape that envelopes said machine.

5. The warning system as recited in claim 4, wherein the current signal provided to each of said wire loops is adjustable so as to adjust the outer envelope shape of said hazardous working zone.

6. The warning system as recited in claim 2, wherein said transmitter includes:

a tuneable oscillator for generating an output signal of selected frequency;

loop driver means for amplifying said output signal generated by said oscillator to form said current signal provided to said transmitter antenna; and a buffer amplifier electrically disposed between said oscillator and said loop driver means for providing isolation between said oscillator and said loop driver means.

7. The warning system as recited in claim 6, wherein said transmitter antenna includes a plurality of individual wire loops and said loop driver means includes a corresponding number of individual loop drivers with each loop driver being connected to a corresponding wire loop.

8. The warning system as recited in claim 6, wherein said oscillator operates at a selected frequency adjustable between 500 Hz and 100 KHz.

9. The warning system as recited in claim 2, wherein said receiver means includes:

a receiver antenna in the form of a ferrite loop operable to detect said magnetic field generated by said transmitter means and to generate a receiver signal in response thereto;

a bandpass filter connected to said ferrite loop for receiving said receiver signal and tuned to said selected frequency of said transmitter means so that all frequencies of said receiver signal other than the frequency corresponding to said selected frequency are stripped from said receiver signal in thereby leaving only said alarm signal;

an amplifier connected to said bandpass filter for receiving said alarm signal and increasing the amplitude of said alarm signal to a usable amplitude; and a signal detector for receiving said alarm signal from said amplifier and converting said alarm signal to a DC voltage proportional in magnitude to the strength of said alarm signal.

10. The warning system as recited in claim 9, wherein said DC voltage generated by said signal detector drives a first light emitting diode device to visually caution an individual of his position relative to said hazardous working zone of said machine in the event the magnitude of said DC voltage has a magnitude below a selected magnitude level.

11. The warning system as recited in claim 10, wherein said first light emitting diode device provides a yellow visual warning light.

12. The warning system as recited in claim 9, wherein said DC voltage generated by said signal detector drives a second light emitting diode device and an alarm driver which excites a peizo alarm to visually and audibly warn an individual of his position relative to said hazardous working zone of said machine in the event the magnitude of said DC voltage has a magnitude above a selected magnitude level.

13. The warning system as recited in claim 12, wherein said second light emitting diode device provides a red visual warning light.

14. The warning system as recited in claim 12, wherein said alarm driver is capable of generating a shutdown signal operable to stop all movement of said working machine in the event the magnitude of said DC voltage has a magnitude above said selected magnitude level.

* * * * *